US007318364B1

(12) United States Patent
Nickolas

(10) Patent No.: US 7,318,364 B1
(45) Date of Patent: Jan. 15, 2008

(54) SHINGLE REMOVING MACHINE

(76) Inventor: Jerry L. Nickolas, Box 786, Athabasca, Alberta (CA) T9S 2A6

( * ) Notice: Subject to any disclaimer, the term of this patent is extended or adjusted under 35 U.S.C. 154(b) by 0 days.

(21) Appl. No.: 11/638,898

(22) Filed: Dec. 14, 2006

(30) Foreign Application Priority Data

May 5, 2006 (CA) ..... 2548920

(51) Int. Cl.
*E04D 15/00* (2006.01)
*B26B 3/00* (2006.01)
*E21C 25/00* (2006.01)

(52) U.S. Cl. ..... 81/45; 30/170; 299/37.1

(58) Field of Classification Search ..... 81/45; 30/169, 170; 299/37.1; 254/22, 27, 131.5; 15/93.1

See application file for complete search history.

(56) References Cited

U.S. PATENT DOCUMENTS 2,519,138 A * 8/1950 Katz ..... 299/37.1
3,376,071 A * 4/1968 Stein ..... 299/37.1
3,779,605 A * 12/1973 Nieman ..... 299/37.1
4,699,430 A 10/1987 Nichols
4,709,479 A 12/1987 Lavelette
7,152,930 B2 * 12/2006 Jertson ..... 299/37.1

* cited by examiner

*Primary Examiner*—Joseph J. Hail, III
*Assistant Examiner*—Bryan R. Muller
(74) *Attorney, Agent, or Firm*—Davis Bujold & Daniels, PLLC

(57) ABSTRACT

A shingle removal tool includes a support frame, a mechanism supported along the bottom of the support frame for moving the shingle removal tool along a surface, and a shingle removal plate having a topside, an underside and a shingle removing end. A rigid linkage has a first end and a second end, wherein the first end of the linkage is hingedly connected to the support frame, and the second end of the linkage is hingedly connected to the underside of the shingle removal plate. A flange depends from the underside of the shingle removing tool, the flange having a length. A rotator is supported by the support frame. A rotatable actuator is rotated by the rotator, and has an eccentric axis of rotation. The rotatable actuator is connected to the flange such that the flange moves about the axis of rotation while maintaining substantially the same orientation, movement of the flange resulting in corresponding movement of the shingle removal plate to which the flange is attached. The connection of the rotatable actuator to the flange being adjustable, thereby altering the shingle removal plate movement.

22 Claims, 5 Drawing Sheets

SHINGLE REMOVING MACHINE

This application claims priority from Canadian Application Serial No. 2,548,920 filed May 5, 2006.

FIELD OF THE INVENTION

The present invention relates to a shingle removing machine.

BACKGROUND OF THE INVENTION

U.S. Pat. No. 4,699,430 (Nichols 1987) and 4,709,479 (Lavelette 1987) are examples of shingle removing machines.

SUMMARY OF THE INVENTION

Accordingly, there is provided a shingle removal tool including a support frame, means supported along the bottom of the support frame for moving the shingle removal tool along a surface, and a shingle removal plate, the shingle removal plate having a topside, an underside and a shingle removing end. A rigid linkage has a first end and a second end, wherein the first end of the linkage is hingedly connected to the support frame, and the second end of the linkage is hingedly connected to the underside of the shingle removal plate. A flange depends from the underside of the shingle removing tool, the flange having a length. A rotator is supported by the support frame. A rotatable actuator is rotated by the rotator, and has an eccentric axis of rotation. The rotatable actuator is connected to the flange such that the flange moves about the axis of rotation while maintaining substantially the same orientation, movement of the flange resulting in corresponding movement of the shingle removal plate to which the flange is attached. The connection of the rotatable actuator to the flange being adjustable, thereby altering the shingle removal plate movement.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
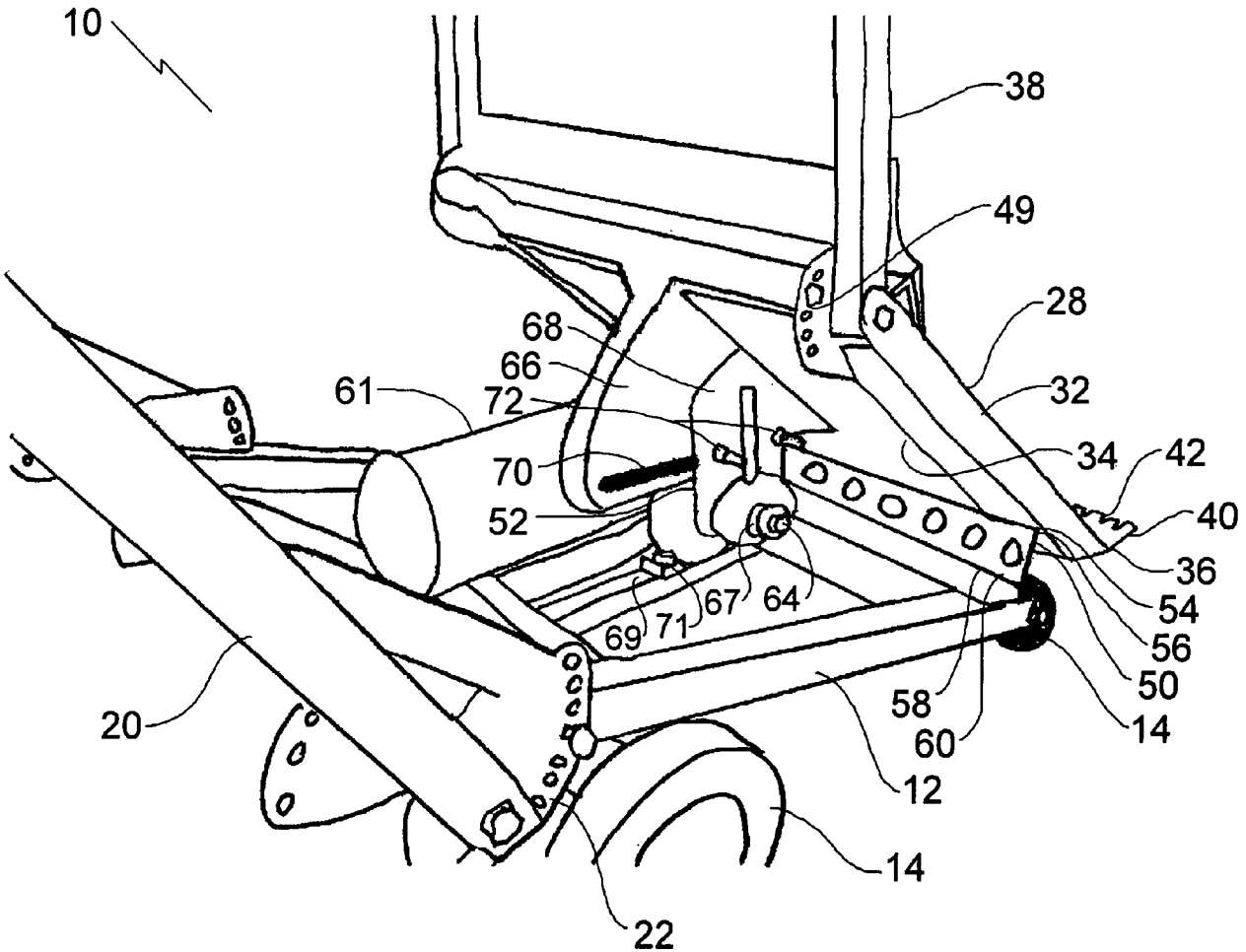
FIG. 1 is a detailed rear perspective view of the shingle removal tool.

The preferred embodiment, a shingle removal tool generally identified by reference numeral 10, will now be described with reference to FIGS. 1 through 8.

Structure and Relationship of Parts:

Referring to FIG. 1, shingle removal tool 10 includes a support flame 12, and means, such as wheels 14 as depicted, supported along the bottom of support flame 12 for moving shingle removal tool 10 along a surface 18. Instead of wheels 14, other means could be used, such as rollers or skids (not shown). An operator's handle 20 is connected to support flame 12 to allow an operator to control the movement of shingle removal tool 10. The angle of operator's handle 20 relative to support frame 12 is adjustable using a pin and hole arrangement 22, although other ways of adjusting the angle are possible. For example, a continuous slot with a tightening bolt, or two profiled surfaces that engage each other when held together.

Figure 2:
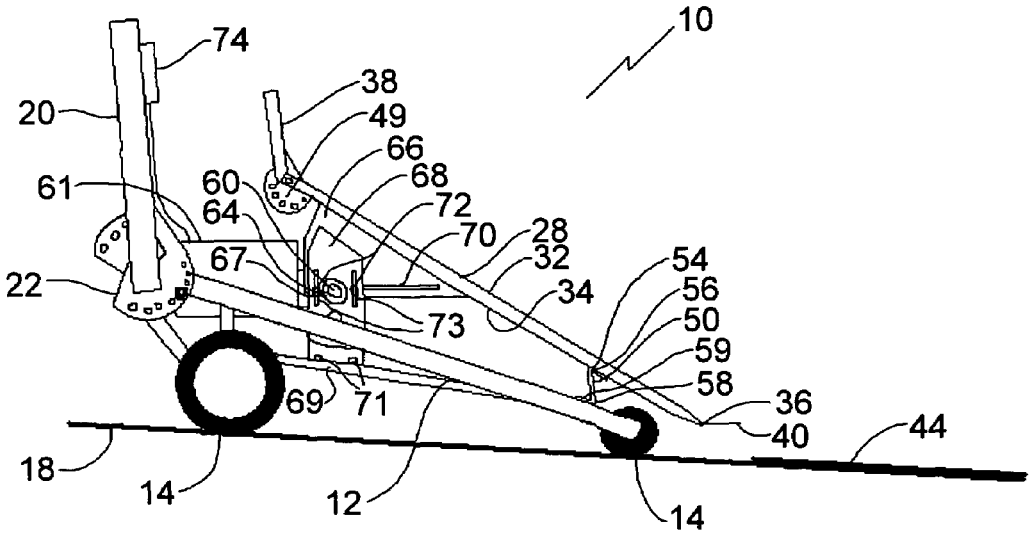
FIG. 2 is a side plan view of the shingle removal tool.
Figure 3:
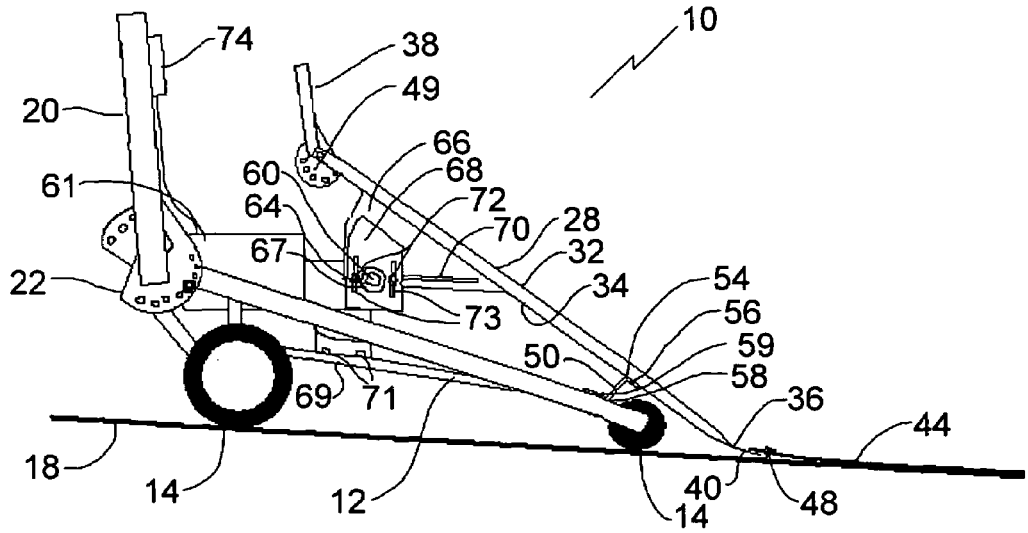
FIG. 3 is a side plan view of the shingle removal tool with the blade positioned under shingles.
Figure 4:
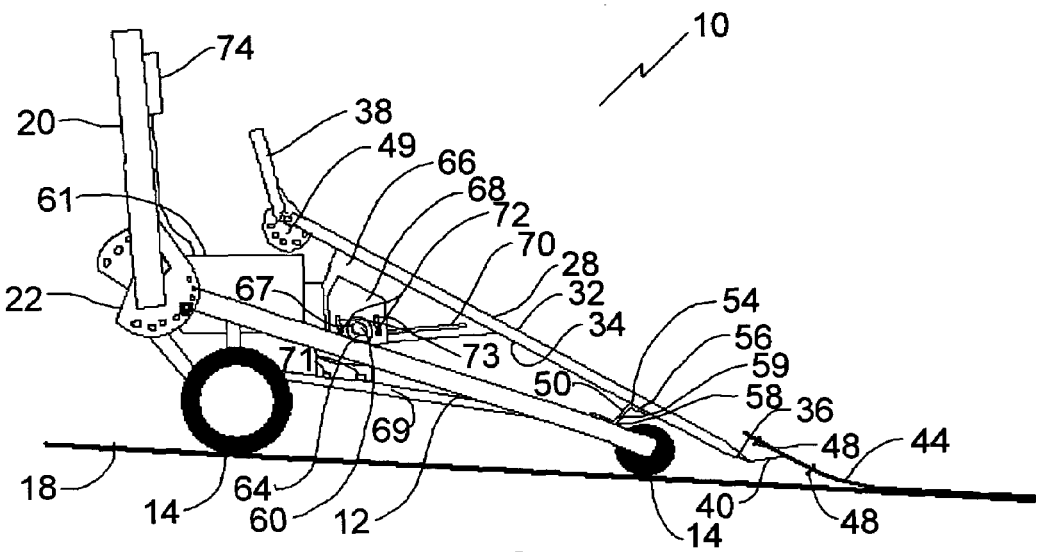
FIG. 4 is a side plan view of the shingle removal tool with the blade lifting the shingles.

Referring to FIG. 2, shingle removal tool 10 also includes a shingle removal plate 28. Shingle removal plate 28 has a topside 32, an underside 34, a shingle removing end 36 and an angled rear portion 38. Shingle removing end 36 comprises a blade 40 with tines 42 (shown in FIG. 6) connected to shingle removal plate 28. Blade 40 is used to work their way below the shingles 44 on a roof 18, and then pry them away from roof 18, as shown in FIGS. 3 and 4. Tines 42 provide a more effective way of removing the nails 48 holding shingles 44. At the other end of shingle removal plate 28, angled rear portion 38 causes removed shingles to curl over so as not to interfere with the operator. The angle of rear portion 38 relative to the shingle removal plate 28 is also adjustable using a pin and hole arrangement 49, although other ways of adjusting the angle are possible as described above.

Figure 5:
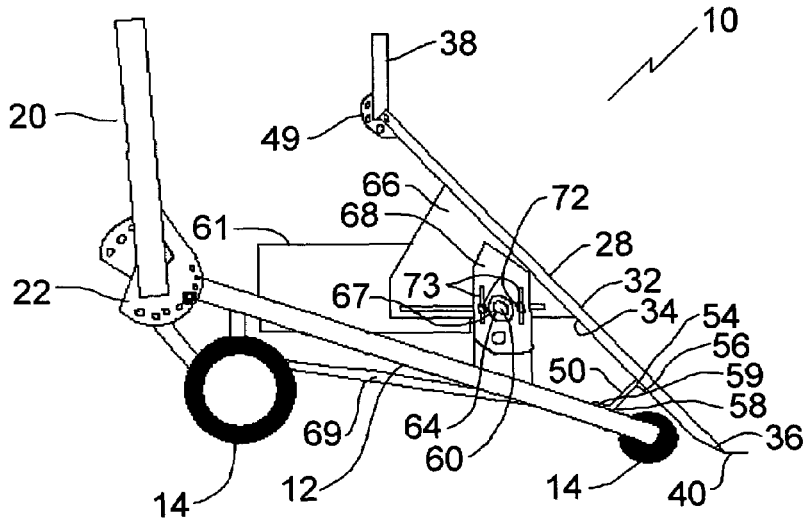
FIG. 5 is a side plan view of the shingle removal tool with the rotatable actuator positioned in a different position.
Figure 6:
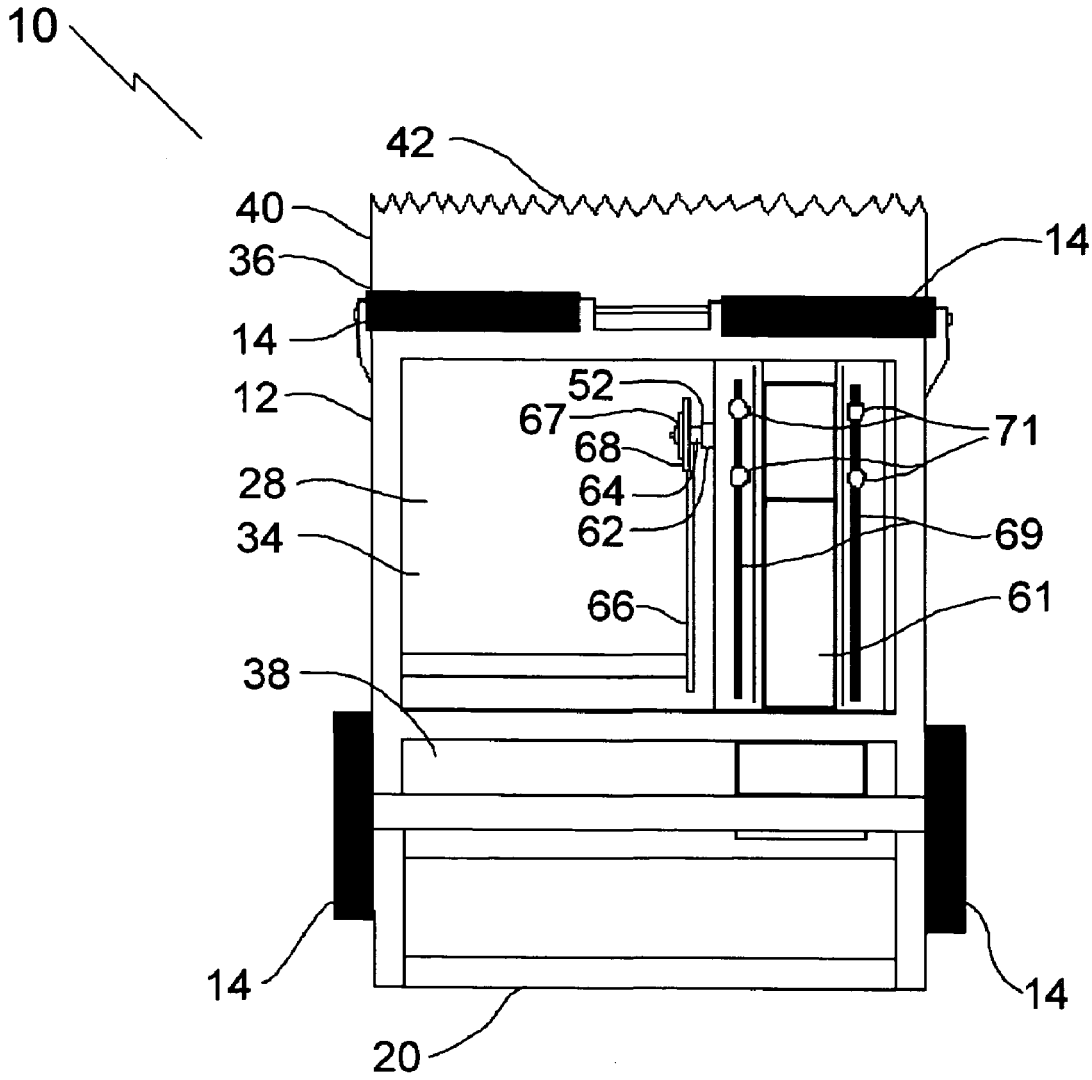
FIG. 6 is a bottom plan view of the shingle removal tool.
Figure 7:
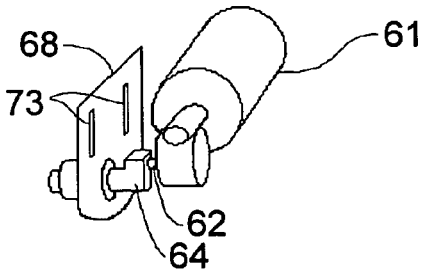
FIG. 7 is a perspective view of the rotatable actuator.

The movement of shingle removal plate 28 is controlled by a rigid linkage 50 and a rotatable actuator 52. Rigid linkage 50 has a first end 54 that is connected to support frame 12 by a hinge 56, and a second end 58 that is connected to underside 34 of shingle removal plate 28 by a hinge 59. Rotatable actuator 52 has an eccentric axis of rotation 60 and is supported by support frame 12. In the depicted embodiment, rotatable actuator 52 is driven by a motor 61 and comprises a shaft 62 that has an offset portion 64. Offset portion 64 is connected along the length of a flange 66 that depends from underside 34. As shown, offset portion 64 has a plate 68 that is connected to flange 66. Flange 66 has a slot 70, such that plate 68 may be attached to different positions along flange 66 by passing bolts 72 through plate 68 and slot 70. Referring to FIG. 6, another set of slots 69 and bolts 71 are used to allow motor 61 to move as plate 68 is moved. Referring to FIG. 5, plate 68 is shown attached at a different position along the length of flange 66. Referring to FIG. 7, slots 73 also allow plate 68 to be positioned vertically. Referring to FIGS. 2 through 4, as rotatable actuator 52 is rotated by motor 61, flange 66 moves about axis of rotation 60 while maintaining substantially the same orientation because of a bearing 67. In other embodiments, rotatable actuator 52 may be a rotating disk or other device, and motor 61 may drive rotatable actuator using a belt arrangement or gears, instead of driving it directly as depicted. In the depicted embodiment, motor 61 is electric (powered by battery or a power source), and a controller 74 is provided on handle 20 close to where the operator will stand. However, other types of motors may be used. For example, a gas powered motor may also be used.

Figure 8:
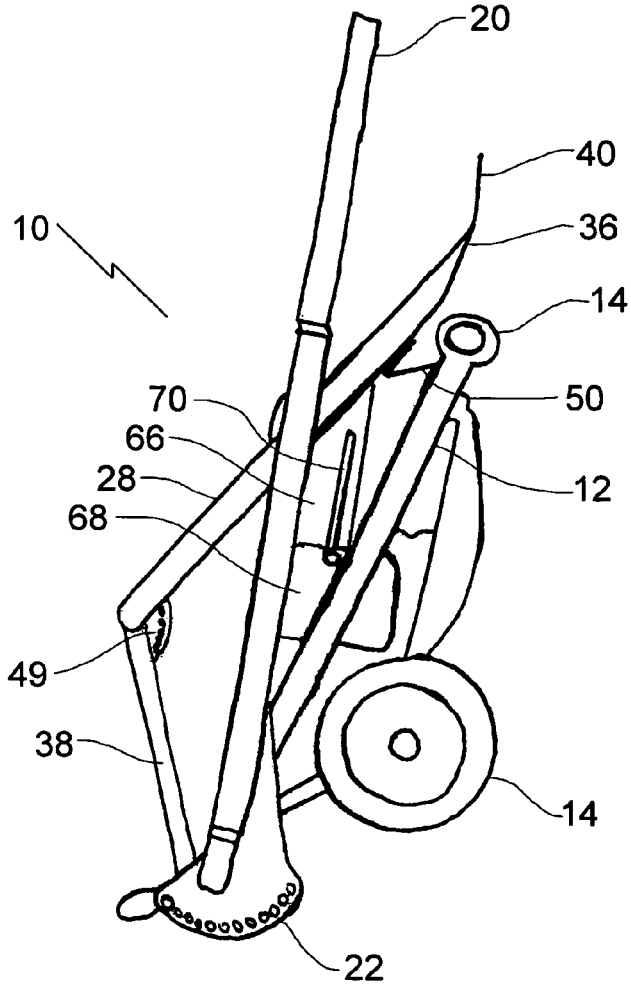
FIG. 8 is a side plan view of the shingle removal tool in a collapsed state.

Operation:

Referring to FIGS. 1 through 8, shingle removal tool 10 is provided as described above. Referring to FIG. 8, shingle removal tool 10 may be folded compactly for ease of transport, and to make it easier to get onto of off of roof 18. This is done by selecting the appropriate positions for pin and hole arrangements 22 and 49. Once shingle removal tool 10 is on roof 18, certain adjustments may be made depending on the preferences of the operator, the pitch of the roof, and the shingles. Referring to FIG. 2, handle 20 is adjustable by adjusting pin and hole arrangement 22 such that the height and angle of handle 20 may be set as desired. The angle of rear portion 38 of shingle removal plate 28 is also adjustable using pin and hole arrangement 49 to ensure that removed shingles curl appropriately. Finally, referring to FIG. 5, the movement of blade 40 of shingle removal plate 28 may be controlled by adjusting the position of plate 68 with respect to flange 66. While the adjustments may be made in any order, the preferred order will be described. The first adjustment involves loosening bolts 71 and 72 and sliding them either forward or backwards within slots 69 and 70, respectively, and tightening bolts 71 and 72 when the desired position is reached. This adjustment changes the "lift" of blade 40, where a more forward position will cause blade 40 to lift more, whereas a position at the back of slots 69 and 70 will result in less lift, but with more force. Once the proper lift is reached, bolts 72 are loosened, and the angle of hinge 50 is set by sliding flange backward or forward (only a small amount of travel is permitted) with respect to plate 68. This adjustment is made to get a more favourable motion, such that blade 40 is pushed under shingles 44 more efficiently. The final adjustment is also made with bolts 72 loosened, the position of plate 68 is adjusted vertically by sliding bolts 72 along slots 73. This adjustment allows the user to set the appropriate orientation. Referring to FIG. 2, once shingle removal tool 10 is properly adjusted, motor 61 is turned on. Referring to FIG. 3, as rotatable actuator 52 rotates, shingle removal plate 28 and thus blade 40 moves in a relatively forward and downward motion as rigid linkage 50 bends along hinges 56 and 59. This allows blade 40 to get under shingles 44. Referring to FIG. 4, as flange 66 is pulled downward by rotating actuator 52, rigid linkage 50 acts as a pivot point, such that blade 40 moves in a relatively upward direction to lift shingles 44 from roof 18. The rest of rotatable actuator's stroke returns rigid linkage 50 and shingle removal plate 28 to its original position.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

What is claimed is:

1. A shingle removal tool, comprising:

a support frame;

means supported along the bottom of the support frame for moving the shingle removal tool along a surface;

a shingle removal plate, the shingle removal plate having a topside, an underside and a shingle removing end;

a rigid linkage having a first end and a second end, wherein the first end of the linkage is hingedly connected to the support frame, and the second end of the linkage is hingedly connected to the underside of the shingle removal plate;

a flange depending from the underside of the shingle removing plate the flange having a length;

a rotator supported by the support frame; and a rotatable actuator rotated by the rotator, the rotatable actuator having an eccentric axis of rotation, the rotatable actuator being connected to the flange such that the flange moves about the axis of rotation while maintaining substantially the same orientation, movement of the flange resulting in corresponding movement of the shingle removal plate to which the flange is attached, the connection of the rotatable actuator to the flange being adjustable, thereby altering the shingle removal plate movement.

2. The shingle removal tool of claim 1, where the shingle removing end of the shingle removal plate comprises a blade connected to the shingle removal plate.

3. The shingle removal tool of claim 2, where the blade comprises tines.

4. The shingle removal tool of claim 1, where the shingle removal plate comprises an angled rear portion, such that removed shingles are curled over as they move up the shingle removal plate.

5. The shingle removal tool of claim 4, where the angle of the angled rear portion is adjustable.

6. The shingle removal tool of claim 1, where the rotatable actuator comprises a shaft, the shaft comprising an offset portion, the offset portion being connected along the length of the flange.

7. The shingle removal tool of claim 1, where the rotator comprises a motor.

8. The shingle removal tool of claim 1, where the rotator comprises a belt or gears driven by a motor.

9. The shingle removal tool of claim 1 further comprising an operator's handle connected to the support frame.

10. The shingle removal tool of claim 9, where the angle of the operator's handle relative to the support frame is adjustable.

11. The shingle removal tool of claim 1, where the means for moving the shingle removal tool along a surface is selected from a group consisting of: wheels, skids, and rollers.

12. The shingle removal tool of claim 1, where the connection of the rotatable actuator to the flange is adjustable vertically along the flange and horizontally along the length of the flange.

13. The shingle removal tool of claim 1, where the shingle removal tool is foldable to a more compact form.

14. A shingle removal tool, comprising:

a support frame;

means supported along the bottom of the support frame for moving the shingle removal tool along a surface;

an operator's handle connected to the support frame;

a shingle removal plate, the shingle removal plate having a topside, an underside and a shingle removing end, the shingle removing end comprising a blade connected to the shingle removal plate, and the shingle removal plate comprising an angled rear portion, such that removed shingles are curled over as they move up the shingle removal plate;

a rigid linkage having a first end and a second end, wherein the first end of the linkage is hingedly connected to the support frame, and the second end of the linkage is hingedly connected to the underside of the shingle removal plate;

a flange depending from the underside of the shingle removing plate, the flange having a length;

a motor supported by the support frame; and a rotatable actuator rotated by the motor and, the rotatable actuator having an axis of rotation, the rotatable actuator comprising a shaft having an offset portion, the offset portion being connected to the flange such that the flange moves about the axis of rotation while maintaining substantially the same orientation, movement of the flange resulting in corresponding movement of the shingle removal plate to which the flange is attached, the connection of the offset portion to the flange being adjustable, thereby altering the shingle removal plate movement.

15. The shingle removal tool of claim 14, where the blade comprises tines.

16. The shingle removal tool of claim 14, where the angle of the angled rear portion relative to the shingle removal plate is adjustable.

17. The shingle removal tool of claim 14, where the motor drives a belt or gears to rotate the rotatable actuator.

18. The shingle removal tool of claim 14, where the angle of the operator's handle relative to the support frame is adjustable.

19. The shingle removal tool of claim 14, where the means for moving the shingle removal tool along a surface is selected from a group consisting of: wheels, skids, and rollers.

20. The shingle removal tool of claim 14, where the connection of the rotatable actuator to the flange is adjustable vertically along the flange and horizontally along the length of the flange.

21. The shingle removal tool of claim 14, where the shingle removal tool is foldable to a more compact form.

22. A shingle removal tool, comprising:

a support frame;

a mechanism supported along the bottom of the support frame for moving the shingle removal tool along a surface selected from a group consisting of: wheels, skids, and rollers;

an operator's handle connected to the support frame, where the angle of the operator's handle relative to the support frame is adjustable;

a shingle removal plate, the shingle removal plate having a topside, an underside and a shingle removing end, the shingle removing end comprising a blade connected to the shingle removal plate, the blade comprising tines, and the shingle removal plate comprising an angled rear portion, such that removed shingles are curled over as they move up the shingle removal plate, where the angle of the angled rear portion relative to the shingle removal plate is adjustable;

a rigid linkage having a first end and a second end, wherein the first end of the linkage is hingedly connected to the support frame, and the second end of the linkage is hingedly connected to the underside of the shingle removal plate;

a flange depending from the underside of the shingle removing tool, the flange having a length;

a motor supported by the support frame; and a rotatable actuator rotated by the motor, the rotatable actuator having an axis of rotation, the rotatable actuator comprising a shaft having an offset portion, the offset portion being connected to the flange such that the flange moves about the axis of rotation while maintaining substantially the same orientation, movement of the flange resulting in corresponding movement of the shingle removal plate to which the flange is attached, the connection of the offset portion to the flange being adjustable vertically along the flange and adjustable horizontally along the length of the flange, thereby altering the movement.

* * * * *